US010403448B2

(12) United States Patent
Collas et al.

(10) Patent No.: US 10,403,448 B2
(45) Date of Patent: Sep. 3, 2019

(54) INTEGRATION OF ELECTRICAL CONTACTS IN AN ELECTRICAL SWITCHING DEVICE

(71) Applicant: Schneider Electric Industries SAS, Rueil Malmaison (FR)

(72) Inventors: Florent Collas, Fontaine (FR); Denis Milan, Voiron (FR); Daniel Verneau, La Motte d'Aveillans (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 72 days.

(21) Appl. No.: 15/845,191

(22) Filed: Dec. 18, 2017

(65) Prior Publication Data

US 2018/0204690 A1 Jul. 19, 2018

(30) Foreign Application Priority Data

Jan. 16, 2017 (FR) ..... 17 50321

(51) Int. Cl.
*H01H 71/04* (2006.01)
*H01H 9/00* (2006.01)
(Continued)

(52) U.S. Cl.
CPC ..... *H01H 9/0066* (2013.01); *H01H 3/28* (2013.01); *H01H 19/62* (2013.01);
(Continued)

(58) Field of Classification Search
CPC ..... H01H 3/28; H01H 9/0066; H01H 19/62; H01H 50/541; H01H 71/04; H01H 71/46
See application file for complete search history.

(56) References Cited

U.S. PATENT DOCUMENTS 4,409,572 A 10/1983 Mostosi
2008/0035456 A1 2/2008 Melchionne, Jr.
(Continued)

FOREIGN PATENT DOCUMENTS

EP 2 028 674 A2 2/2009
EP 2 728 599 A1 5/2014
(Continued)

OTHER PUBLICATIONS

French Preliminary Search Report dated Sep. 20, 2017 in French Application 17 50321 filed on Jan. 16, 2017 (with English Translation of Categories of Cited Documents and Written Opinion).

*Primary Examiner* — Ramon M Barrera
(74) *Attorney, Agent, or Firm* — Oblon, McClelland, Maier & Neustadt, L.L.P.

(57) ABSTRACT

An electrical switching device, including a socket, a holder and electrical contacts housed in the holder. The holder includes a first end and a second end. The device includes a guidance device for guiding the first end of the holder relative to the socket. The device includes a fastener including a head, a tail, a first stem extending from the head to the tail, and a second stem extending from the head. The first stem is configured for passing through the holder and for being inserted at the tail into a first orifice of the socket, in order to retain the first end of the holder relative to the socket. A retaining member is configured for retaining the fastener, in order to rigidly connect the second end of the holder to the socket.

14 Claims, 3 Drawing Sheets

(51) Int. Cl.

| | |
|---|---|
| ***H01H 3/28*** | (2006.01) |
| ***H01H 19/62*** | (2006.01) |
| ***H01H 50/54*** | (2006.01) |
| ***H01H 71/46*** | (2006.01) |

(52) U.S. Cl.
CPC ..... *H01H 50/541* (2013.01); *H01H 71/04* (2013.01); *H01H 71/46* (2013.01)

(56) References Cited

U.S. PATENT DOCUMENTS

| | | | |
|---|---|---|---|
| 2009/0051470 | A1 | 2/2009 | Yang et al. |
| 2014/0116987 | A1 | 5/2014 | Lee et al. |
| 2015/0311015 | A1 | 10/2015 | Magoni et al. |

FOREIGN PATENT DOCUMENTS

| | | | |
|---|---|---|---|
| GB | 2 096 396 | A2 | 10/1982 |
| WO | WO 2007/092859 | A1 | 8/2007 |
| WO | WO 2014/106538 | A1 | 7/2014 |

INTEGRATION OF ELECTRICAL CONTACTS IN AN ELECTRICAL SWITCHING DEVICE

TECHNICAL FIELD

The invention relates to the integration and connection of an electrical contact block in a socket of an electrical switching device intended for a medium or high voltage electrical installation, i.e. a device operating at a voltage higher than 1 000 V.

PRIOR ART

In the present document, the term electrical switching device equally includes a plurality of types of electrical devices such as a switch, a circuit breaker, a contactor, a disconnector, etc. The electrical switching devices of known structure for medium or high voltage electrical installation include a socket comprising a mechanism actuating main electrical contacts. In addition, auxiliary electrical contacts may be added and assembled in the socket for providing information on the status of the main contacts.

The assembly of the auxiliary contacts on the socket requires tools such as pliers and a screwdriver. It is relatively difficult and time-consuming to add an additional auxiliary contact or to replace a defective auxiliary contact in this type of device.

DISCLOSURE OF THE INVENTION

The invention aims to at least partially solve the problems encountered in the solutions of the prior art and to provide a system for integrating and connecting electrical contacts that is economical and easy to implement.

In this respect, the subject matter of the invention is an electrical switching device. The device includes a socket, a contact block and a shaft that is rotatably mobile relative to the socket.

The contact block includes a holder and electrical contacts located in the housings of the holder. The holder includes a first end and a second end opposite the first end.

The shaft is configured for actuating the electrical contacts, when the holder is mechanically connected to the socket.

According to the invention, the device comprises a guidance means for guiding the first end of the holder relative to the socket between a separation position and a connection position, a fastener and a retaining member.

The fastener includes a head, a tail, a first stem extending from the head to the tail, and a second stem extending from the head. The first stem is configured for passing through the holder and for being inserted at the tail into a first orifice of the socket, so as to retain the first end of the holder relative to the socket.

The retaining member is rigidly connected to the socket. It is configured for retaining the fastener, so as to rigidly connect the second end of the holder to the socket.

Thanks to the invention, the assembly of an electrical contact on the socket is easier. This makes it easier for an operator to add, remove and/or move an electrical contact with respect to the holder. The replacement of an electrical contact is also made easier. The number of auxiliary contacts may be reduced to the minimum required.

The electrical contacts are notably auxiliary electrical contacts configured for monitoring the operation of main electrical contacts that are linked to the socket of the electrical switching device and for providing information on the status of these main contacts.

The retaining member is notably configured for retaining the stems of the fastener, so as to rigidly connect the second end of the holder to the socket.

The invention may optionally comprise, one or more of the following features optionally combined with each other.

Advantageously, the second stem also extends from the head to the tail. The second stem is configured for being inserted at the tail into a second orifice of the socket, for rigidly connecting the first end of the holder relative to the socket.

The tail of the fastener is then better immobilized with respect to the socket.

Advantageously, the head of the fastener has a general U shape, the first stem forming a first branch of the U, the second stem forming a second branch of the U.

According to one particular embodiment, the holder is configured for pivoting about the first stem when the first stem engages the retaining member, so that the retaining member engages the second stem and so that the electrical contacts may be actuated by the shaft.

The holder may then be easily immobilized with respect to the socket.

According to one advantageous embodiment, the socket includes a first plate and a second plate facing the first plate, the holder being configured for extending between the plates. The first end of the holder is configured for being connected to the first plate, the second end of the holder is configured for being connected to the second plate. The retaining member includes a first groove and a second groove made in the second plate. The first groove is intended to receive the first stem, the second groove is intended to receive the second stem.

Preferably, the retaining member includes a third groove that is perpendicular to the other two grooves, the third groove being intended to receive the head of the fastener in the connection position.

Advantageously, the head of the fastener is configured for being moved in the direction of the first end of the holder when the holder is in the connection position and the retaining member retains the head of the fastener.

The risk of accidental withdrawal of the fastener is thus reduced.

According to one particular embodiment, the device includes a cover configured for being connected to the socket covering the head of the fastener.

The risk of accidental withdrawal of the fastener is further reduced since the cover must first be removed before being able to withdraw the electrical contact block, notably the fastener.

Preferably, the cover is configured for indicating at least one item of information relating to the position of the electrical contacts relative to the holder, in particular the main electrical contacts relative to the socket.

Maintenance operations are therefore made easier.

According to one advantageous embodiment, the guidance means for guiding the first end is configured for guiding the first end of the holder in translation from the separation position to the connection position.

The guidance of the first end of the holder between the separation position and the connection position is easy.

Preferably, the guidance means for guiding the first end is configured for guiding the first end of the holder in rectilinear translation between the separation position and the connection position.

Advantageously, the guidance means for guiding the first end includes a notch in the socket and a protuberance of the first end of the holder which is intended to be inserted into the notch.

According to one particular embodiment, the first stem and/or the second stem is/are configured for passing through the electrical contacts, for immobilizing the contacts relative to the holder.

The fastener rigidly connects both the holder to the socket and the electrical contacts to the holder. This simplifies the assembly of the electrical contacts in the socket.

According to an advantageous embodiment, the electrical contacts are auxiliary contacts configured for providing an item of information representative of the status of the main contacts, being actuated by the shaft.

The invention also relates to an electrical contact block for an electrical switching device.

The contact block includes electrical contacts and a holder including housings for the electrical contacts. The contacts are configured for being actuated by a shaft of the device that is rotatably mobile relative to the socket when the holder is mechanically connected to the socket. The holder includes a first end and a second end opposite the first end.

According to the invention, the electrical contact block includes a fastener and a guidance means for guiding the first end of the holder relative to a socket of the device between a separation position and a connection position.

The fastener includes a head, a tail, a first stem extending from the head to the tail, and a second stem extending from the head.

The first stem is configured for being inserted at the tail into a first orifice of the socket, so as to retain the first end of the holder relative to the socket.

The fastener is configured for being retained relative to the socket by a retaining member, for rigidly connecting the second end of the holder to the socket.

The retaining member is notably configured for retaining the stems of the fastener.

The invention also relates to a connection method for connecting an electrical contact block to a socket of a device as defined above.

The connection method includes the guidance of the first end of the holder relative to the socket from the separation position to the connection position.

It includes the insertion of the first stem through the holder, into the first orifice, and the connection of the fastener to the retaining member, so that the holder is rigidly connected to the socket and the electrical contacts may be actuated by the shaft.

Advantageously, the holder pivots about the first stem, when the first stem engages the retaining member and before the second stem engages the retaining member, so that the retaining member engages the second stem and the electrical contacts may be actuated by the shaft.

Finally, the invention relates to a separation method for separating an electrical contact block from a socket of a device as defined above.

The detachment method includes the detachment of the head of the fastener and the retaining member. It includes the withdrawal of the first stem from the first orifice through the holder. It includes the guidance of the first end of the holder relative to the socket from the connection position to the separation position.

BRIEF DESCRIPTION OF THE DRAWINGS

The invention will be better understood on reading the description of embodiments, given purely as a guide and in no way restrictive, referring to the attached drawings, in which.

DETAILED DESCRIPTION OF PARTICULAR EMBODIMENTS

Identical, similar or equivalent parts of the different figures bear the same numeric references so as to facilitate comparison between one figure and another.

Figure 1:
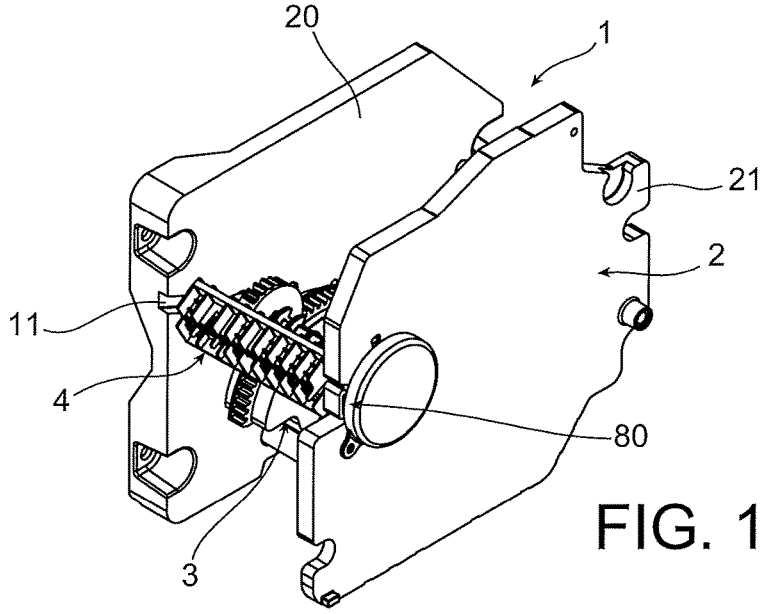
FIG. 1 is a partial representation in elevation of a socket and a contact block mechanically connected to the socket, according to a first embodiment.
Figure 2:
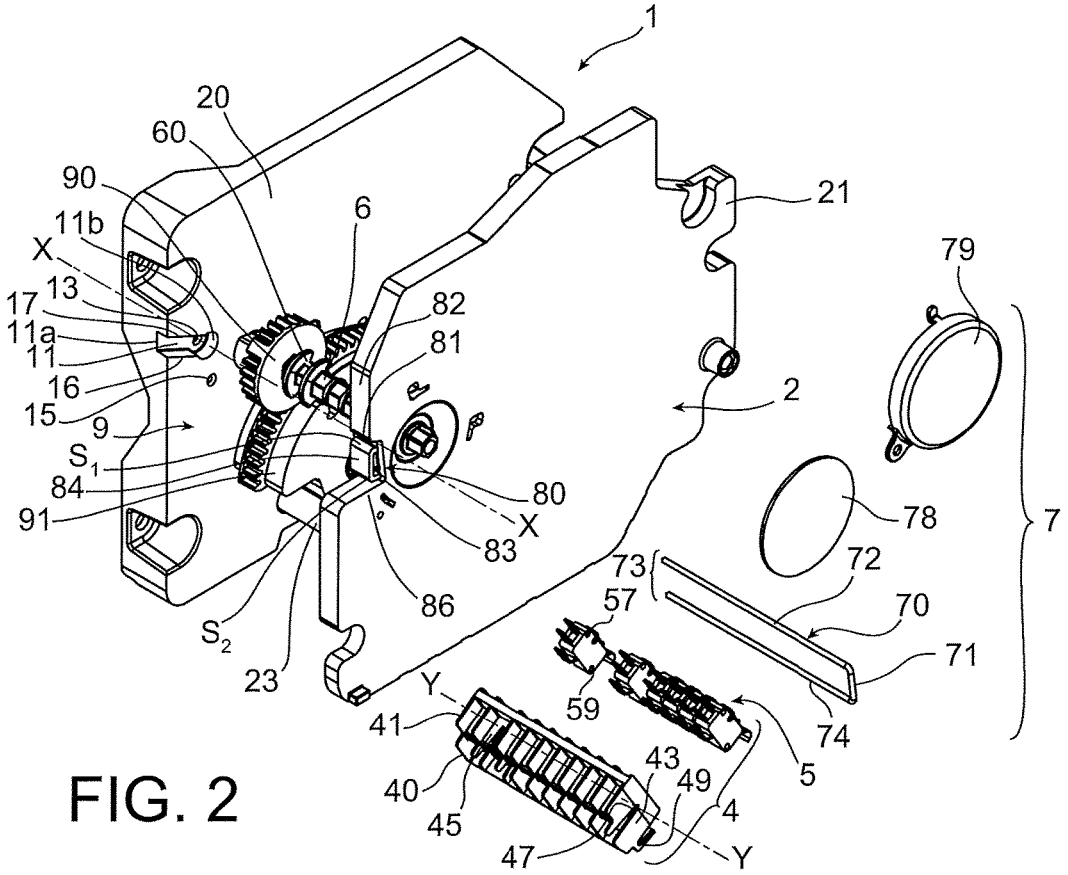
FIG. 2 is a partially exploded representation of the device according to a first embodiment.

FIGS. 1 and 2 represent a part of an electrical connection device 1 for medium or high voltage electrical lines. The device 1 includes a socket 2, main electrical contacts not represented in the figures, an operating member 3 for operating the main contacts and an auxiliary contact block 4.

The device 1 also comprises a fastening system 7 for fastening the block of auxiliary contacts to the socket, and a geared movement transmission system 9 for transmitting the movement between the operating member 3 for operating the main contacts and the auxiliary contact block 4.

The socket 2 includes a first plate 20 and a second plate 21 which is located facing the first plate 20 and which is parallel to the first plate 20. The socket 2 includes at least one transverse bar 23 which extends structurally between the plates 20, 21 in a transverse direction X-X of the socket 2.

The device 1 includes a main shaft (not represented) and an auxiliary shaft 6 each extending between the plates 20, 21 along the transverse direction X-X, the longitudinal axis thereof being substantially orthogonal to the plates 20, 21.

The main shaft is mechanically connected at each end thereof to one of the plates 20, 21, being rotatably mobile relative to the plates 20, 21. Similarly, the auxiliary shaft 6 is mechanically connected at each end thereof to one of the plates 20, 21, being rotatably mobile relative to the plates 20, 21.

The auxiliary shaft 6 includes a plurality of cams 60 which are spaced apart from each other along the longitudinal direction of the auxiliary shaft 6. The cams 60 are each configured for mechanically engaging one of the electrical contacts of the auxiliary contact block 4. In the represented embodiment, the auxiliary shaft 6 is connected in a non-removable manner to the socket 2.

The main shaft comprises at one end thereof a first gear wheel 91. The auxiliary shaft 6 comprises at one end thereof a second gear wheel 90 that is configured to form a gear drive with the first gear wheel 91. The first gear wheel 91 and the second gear wheel 90 render the auxiliary shaft 6 rigidly connected to the main shaft for rotation therewith and together form the movement transmission system 9.

The main electrical contacts are actuated by the main shaft.

The auxiliary contact block 4 includes auxiliary electrical contacts 5 and a holder 40 for the auxiliary contacts 5. The auxiliary electrical contacts 5 are actuated by the auxiliary shaft 6.

The auxiliary electrical contacts 5 are designed to be mounted in the holder 40 with their sides next to each other. Each of the two opposing sides thereof is passed through by a first mounting hole 57 and by a second mounting hole 59 which is offset with respect to the first mounting hole 57.

The auxiliary contacts 5 are intended to be in mechanical contact with cams 60 of the auxiliary shaft 6, being configured for being closed or opened when they are actuated by the cams 60. Each auxiliary contact 5 is configured for providing information representative of the status of the main contacts.

Figure 3:
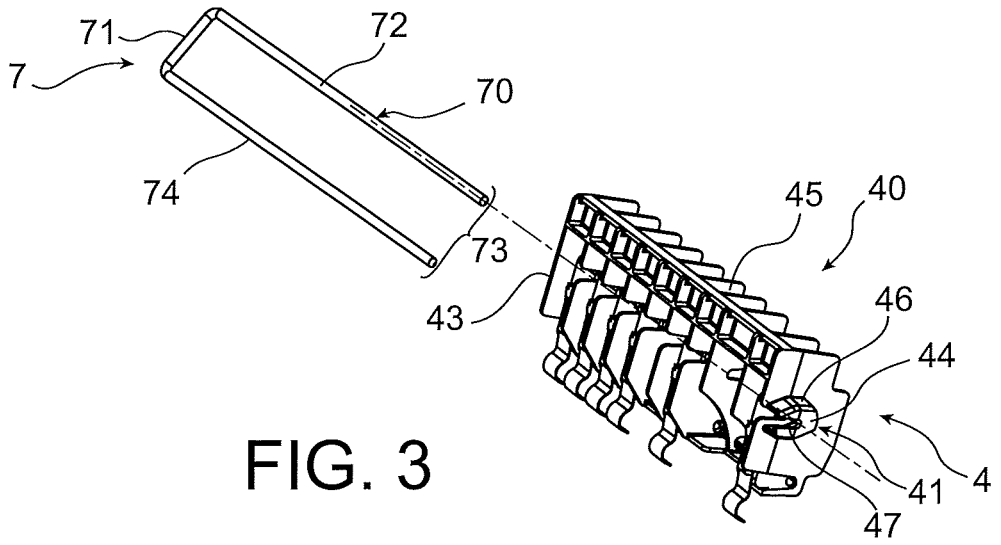
FIG. 3 is a partial schematic representation in elevation of a contact holder for the device according to the first embodiment.

Referring to FIG. 3, the auxiliary contact holder 40 extends along the longitudinal direction Y-Y thereof from a first end 41 to a second end 43 opposite the first end 41. It includes a plurality of contiguous compartments 45 between the ends 41, 43 thereof. These compartments 45 each form a housing for one of the auxiliary contacts 5. Some compartments 45 may optionally remain empty, in order to be able to change the number and arrangement of the auxiliary contacts 5 in the holder 40.

The holder 40 is passed right through in the longitudinal direction Y-Y by a first orifice 47 known as the upper orifice and a second orifice 49 known as the lower orifice. These orifices 47, 49 pass through each of the compartments 45. The first orifice 47 extends substantially along a median line of the holder 40. The second orifice 49 is substantially parallel to the first orifice 47, being offset from the first orifice 47 towards one of the lateral edges of the holder 40.

The first orifice 47 is intended to be aligned with the first mounting hole 57 of each auxiliary contact 5 housed in the holder 40. The second orifice 49 is intended to be aligned with the second mounting hole 59 of each auxiliary contact 5 which is housed in one of the compartments 45.

Figure 6:
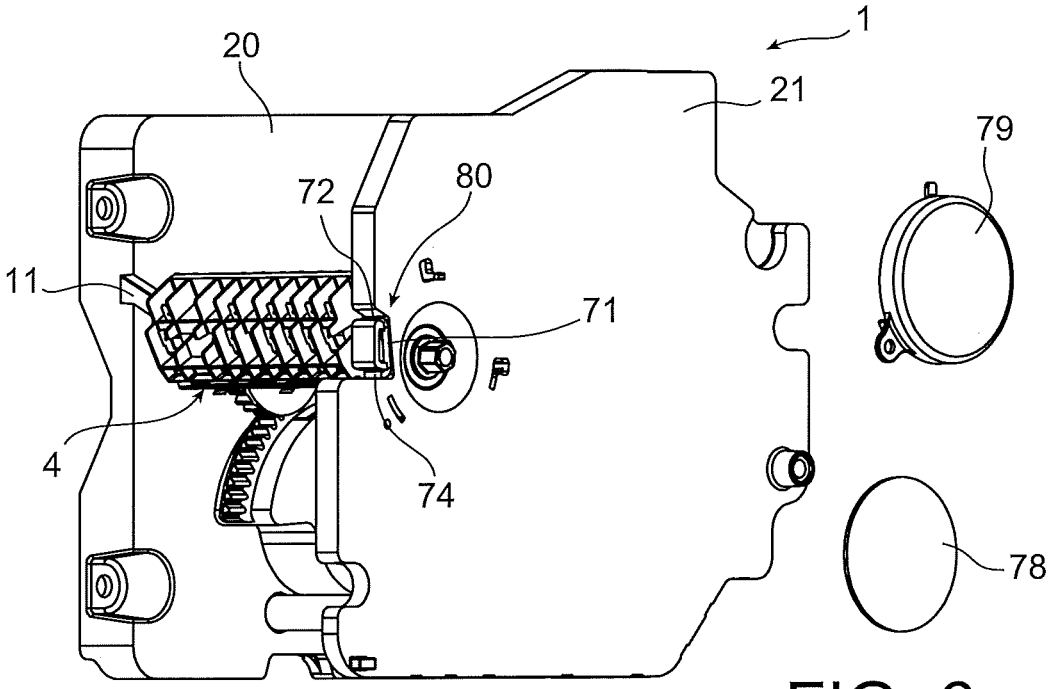

The holder 40 is mobile relative to the socket 2 between a separation position which is represented in FIG. 2 and in which it is located at a distance from the socket 2 and a connection position which is represented in FIG. 6, and in which it is mechanically connected to the socket 2.

The holder 40 extends in the connection position between the plates 20, 21 in a transverse direction X-X of the socket 2. The longitudinal direction Y-Y of the holder is then parallel to the transverse direction X-X of the socket. In the connection position, the first end 41 of the holder 40 is mechanically connected to the first plate 20 and the second end 43 of the holder is mechanically connected to the second plate 21.

The first end 41 of the holder 40 includes a protuberance 44 which juts out along the longitudinal axis Y-Y from the rest of holder 40. The protuberance 44 is substantially located at the centre of the holder 40 in transverse section in a plane orthogonal to the longitudinal axis Y-Y. The protuberance 44 includes two opposite lateral edges 46, each of which forms a substantially flat surface on the side of the protuberance 44.

The protuberance 44 is passed through by the first orifice 47 which is located substantially at the centre of the protuberance 44. The second orifice 49 is offset transversely with respect to the protuberance 44.

The second end 43 of the holder is delimited by a substantially plane surface that is orthogonal to the longitudinal axis Y-Y. The second end 43 of the holder is passed through by the first orifice 47 and by the second orifice 49.

The auxiliary contacts 5 are each rigidly connected to the holder 40 by a fastener 70 which has a general U shape.

The fastener 70 includes a first stem 72 and a second stem 74, which each form one of the branches of the U of the fastener 70. The stems 72, 74 are substantially parallel to each other. They are configured for being substantially parallel to the longitudinal direction Y-Y of the holder 40.

The fastener 70 also includes a head 71 and a tail 73 which are each located at one of the longitudinal ends of each stem 72, 74. The tail 73 is formed by the first longitudinal end of each stem 72, 74. The stems 72, 74 are not connected to each other at the tail 73. The head 71 has the shape of a transverse bar which is integral with the second longitudinal end of each stem 72, 74 and which connects same with each other.

The first stem 72 and the second stem 74 are intended to fasten the auxiliary contacts 5 to the holder 40. The first stem 72 is configured for being inserted into the first orifice 47 and into the first hole 57 of each auxiliary contact 5. The second stem 74 is configured for being inserted into the second orifice 49 and into the second hole 59 of each auxiliary contact 5 which is housed in the holder 40. The stems 72, 74 then rigidly connect the auxiliary contacts 5 to the holder 40 by immobilizing same relative to the holder 40.

The head 71 of the fastener 70 is configured for mechanically cooperating with a retaining member 80, both for guiding and orienting the head 71 relative to the second plate 21 and for rigidly connecting the head 71 to the second plate 21. This retaining member 80 will be described below.

The tail 73 of the fastener is intended to be inserted into orifices 13, 15 of the socket 2, for immobilizing the tail 73 of the fastener 70 relative to the plate 20 of the socket 2.

The socket 2 includes a notch 11, located on the inner face of the first plate 20, for guiding the first end 41 of the holder relative to the socket 2, before retaining the tail 73 relative to socket 2.

The notch 11 is located on the inner side of the first plate 20. It extends from its entrance 11*a*, which opens onto the outside of the first plate 20, up to an opposite end 11*b* which is circular in shape and which includes the first orifice 13 in its centre.

The notch 11 has a substantially rectilinear shape between its entrance 11*a* and its end 11*b* and it is inclined with respect to the transverse direction X-X. The notch has two opposite lateral sides 16, 17 which are each substantially plane and which each extend from the entrance 11*a* up to the end 11*b*.

The notch 11 is intended to receive the protuberance 44 of the first end 41 of the holder 40, guiding the movement of the protuberance 44 thanks to the shape cooperating with the notch 11. The lateral sides 16, 17 of the notch notably have a complementary shape to that of the edges 46 of the protuberance, so that it can be slid into the notch 11. The notch 11 is capable of guiding the protuberance in rectilinear translation between its entrance 11*a* and its end 11*b*.

The notch 11 and the protuberance 44 therefore act as a guidance means for guiding the first end 41 of the holder relative to the first plate 20. They are configured for guiding the first end 41 of the holder from its separation position to its connection position.

After the protuberance 44 is housed in the end 11*b* of the notch 11 and the holder 40 has pivoted about the first stem 72, the first stem 72 is configured for passing through the protuberance 44 by being inserted into the first orifice 13. Simultaneously with the insertion of the first stem 72 into the first orifice 13, the second stem 74 is configured for being inserted at the first end 41 of the holder into the second orifice 15.

The first orifice 13 and the second orifice 15 are blind holes arranged on the inner face of the first plate 20. They are intended to retain the tail 73 of the fastener 70 relative to the socket 2. Together they then form a retaining means for retaining the first end 41 of the holder relative to the socket 2.

The second plate 21 includes a first groove 81, known as the upper groove and a second groove 83, known as the lower groove.

The first groove 81 extends substantially in the transverse direction X-X of the socket passing through the second plate 21 in this direction. The first groove 81 is substantially opposite the first orifice 13.

The second groove 83 extends substantially in the transverse direction X-X of the socket passing through the second plate 21 in this direction. The second groove 83 is located substantially opposite the second orifice 15.

The second plate 21 includes an upper flange 82 above the first groove 81, an intermediate flange 84 between the grooves 81, 83 and a lower flange 86 below the second groove 83.

The intermediate flange 84 is delimited at the first groove 81 by a first contact surface $S_1$ with the first stem 72. It is delimited at the second groove 83 by a second contact surface $S_2$ with the second stem 74.

The first groove 81 is intended to receive the first stem 72 once the protuberance 44 is engaged in the end 11*b* of the notch 11, the first stem 72 being supported on the intermediate flange 84.

The first groove 81 is intended to cause the first stem 72 to pivot about its longitudinal axis. The pivoting of the first stem 72 causes the holder 40 to pivot about this axis and allows the second stem 74 to be introduced into the second groove 83.

The second groove 83 is intended to receive the second stem 74 when the holder 40 has pivoted about the first stem 72, the second stem 74 being supported on the intermediate flange 84. The head 71 of the fastener is immobilized in all directions except optionally in translation in the transverse direction X-X, when the first stem 72 is in the first groove 81 and the second stem 74 is in the second groove 83.

The first groove 81, the intermediate flange 84 and the second groove 83 therefore act both as a guidance means for guiding the second end 43 of the holder relative to the second plate 21, and as the retaining means for retaining the second end 43 of the holder relative to the second plate 21. Together they form the retaining member 80.

The head 71 of the fastener is configured for being moved in the direction of the first end 41 of the holder, when the holder 40 is in the connection position and the retaining member 80 retains the head 71 of the fastener.

For this the retaining member 80 comprises, for example, a third groove 85, which is perpendicular to the first and second grooves 81, 83, and into which the head 71 is inserted when the holder 40 is in the connection position. The fastener 70 is notably intended to come into contact with the retaining member on three sides of the intermediate flange 84.

When the head 71 of the fastener moves in the transverse direction X-X until coming into mechanical contact with the intermediate flange 84, the first stem 72 is inserted into the first orifice 13 and the second stem 74 is inserted into the second orifice 15.

The device 1 includes a cover 78 configured for engaging one end of the auxiliary shaft 6 through the first plate 20, and for covering the head 71 of the fastener. The cover 78 includes on its surface information relating to the position of the electrical contacts 5 relative to the holder 40, for facilitating the intervention of an operator on the device 1.

The device 1 also comprises a cap 79 configured for covering the cover 78. The cap 79 is configured for being screwed onto the first plate 20. It is transparent forming a window allowing an operator to read the information on the cover 78.

The cover 78 and the cap 79 prevent the accidental withdrawal of the fastener 70 from the socket 2. They act as a retaining means for retaining the head 71 of the fastener in the transverse direction X-X. Indeed, it is necessary to first remove the cover 78 and the cap 79 before being able to withdraw the fastener 70 and the rest of the electrical contact block 4.

The fastener 70, the cover 78 and the cap 79 together form the fastening system 7 for fastening the auxiliary contact block 4 to the socket 2.

The electrical connection method for connecting the auxiliary electrical contact block 4 to the main contact block 3 is now described below.

First of all, referring to FIG. 3, the auxiliary electrical contacts 5 are inserted into the compartments 45 of the holder. The first stem 72 and the second stem 74 are inserted through the holder 40 and the auxiliary electrical contacts 5. The auxiliary contacts 5 are then fastened to the holder 40.

Figure 4:
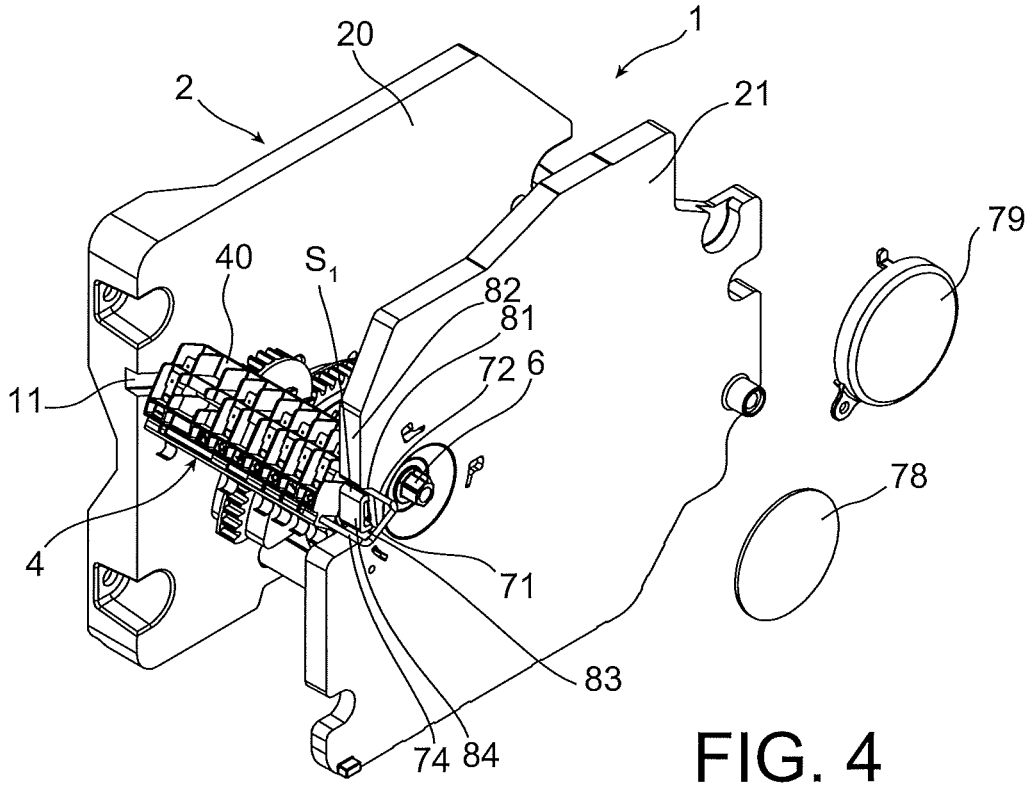
FIGS. 4 to 6 are partial schematic representations in elevation illustrating the successive steps of connecting an electrical contact block to a socket of an electrical device according to the first embodiment of the invention.

Referring to FIG. 4, the protuberance 44 is guided into the notch 11 of the first plate 20, from the separation position of the holder 40 up to its connection position. Simultaneously, the first stem 72 is inserted into the first groove 81 of the second plate 21. In FIG. 4, the holder 40 is then in an intermediate position in which the first stem 72 is engaged in the first groove 81 and the second stem 84 is not yet engaged in the second groove 83.

Figure 5:
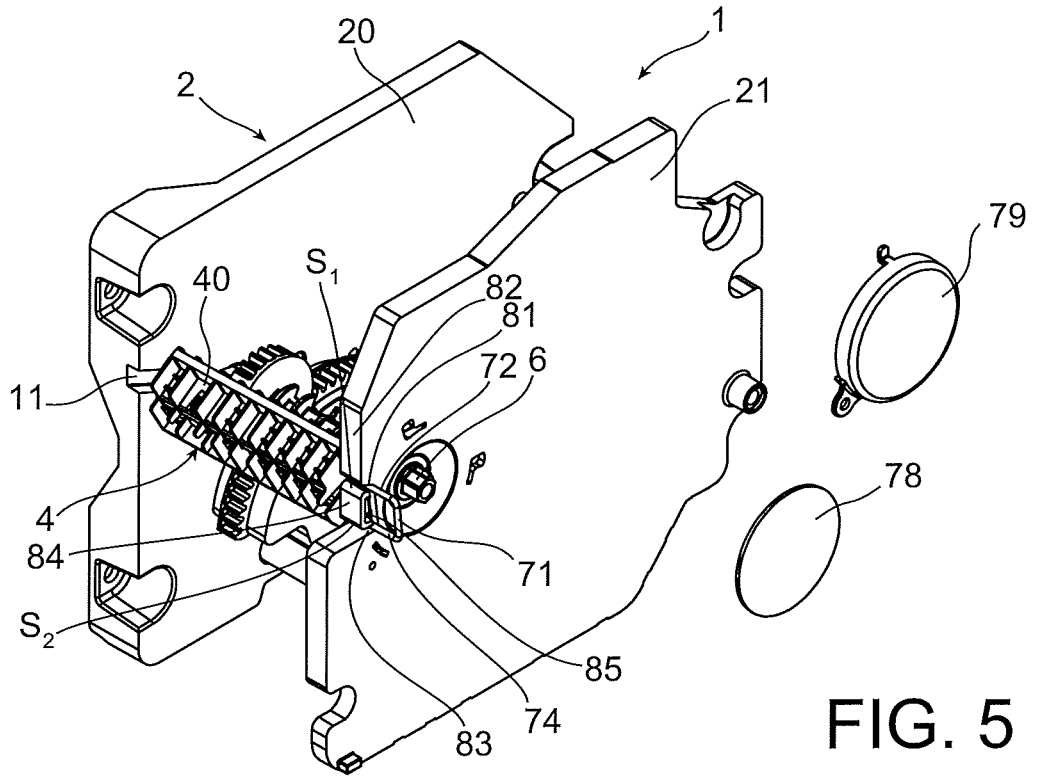

Referring to FIG. 5, the first stem 72 pivots about its longitudinal axis. The holder 40 being rigidly connected for rotation with the first stem 72, it pivots about its longitudinal axis Y-Y relative to the socket 2. The first stem 72 pivots until the second stem 74 is inserted into the second groove 83 of the second plate 21. The head 71 is then retained with respect to the second plate 21.

When the first stem 72 is retained in the first groove 81 and the second stem 74 in the second groove 83, the auxiliary electrical contacts 5 are close to the auxiliary shaft 6 and they may be closed when they are actuated by the cams 60 of the auxiliary shaft 6.

Referring to FIG. 6, the head 71 of the fastener is pushed in the transverse direction X-X in the direction of the first plate 20 until coming into mechanical contact with the intermediate flange 84. The tail 73 of the fastener is inserted into the first orifice 13 and into the second orifice 15, when the fastener 70 is pushed. The holder 40 is then fastened to the socket 2, by being rigidly connected to the socket 2. The holder 40 is in the connection position.

Referring to FIG. 6 and FIG. 1, the cover 78 and the cap 79 are then assembled on the second plate 21, which further limits the risk of withdrawal of the fastener 70.

The separation method for separating the auxiliary electrical contact block 4 from the socket 2 is now described below.

First of all, the cover 78 and the cap 79 are removed from the socket 2, which makes it possible to extract the head 71 of the fastener in the transverse direction X-X opposite the first plate 20. The tail 73 of the fastener is then removed from the first orifice 13 and from the second orifice 15. The fastener 70 is then optionally disengaged from some of the auxiliary contacts 5.

The first stem 72 pivots about its longitudinal axis, which makes it possible to take out the second stem 74 from the second groove 83.

The holder 40 is then guided into the notch 11 from the end 11*b* of the notch up to the entrance 11*a* of the notch, with an operator holding the fastener 70. The auxiliary contact block 4 is then moved away from the socket 2.

The first stem 72 and the second stem 74 are withdrawn from the first orifice 47 and from the second orifice 49 of the holder. Once the fastener 70 is removed from the holder 40, the auxiliary contacts 5 may be extracted from their housing. Auxiliary contacts 5 may then be removed, added, or moved in the holder 40. Auxiliary contacts 5 may also be replaced.

Of course, various modifications may be made by the person skilled in the art to the invention that has just been described without departing from the scope of the disclosure of the invention.

The shape of the fastener 70 may vary. For example, the head 71 of the fastener may have an undulating shape. The stems 72 of the fastener 74 may not be parallel with each other. Furthermore, the stems 72, 74 may have different lengths from each other or different diameters from each other.

According to one embodiment (not represented), the second stem 74 is shorter than the first stem 72 and the fastener 70 is in mechanical contact with the first plate 20 only via the first orifice 13.

The notch 11 may also have a different shape. It may be, for example, a curvilinear notch 11 instead of a rectilinear notch.

According to the shape of the first end of the holder 41, the first plate 20 may even include a plurality of notches.

The retaining member 80 may also have a different shape. The shape of the head 71 of the fastener is then adapted to the shape of the retaining member 80. The retaining member may be, for example, an element added onto the second plate 21, such as a clip.

The device 1 may lack any cover 78 and/or any cap 79.

The auxiliary shaft 6 and/or the main shaft may be removable with respect to the socket 2. They may be optionally removable from each other.

The invention claimed is:

1. An electrical switching device, comprising:

a socket, an electrical contact block including a holder and electrical contacts located in housings of the holder, the holder including a first end and a second end opposite the first end, a shaft that is rotatably mobile relative to the socket, the shaft being configured for actuating the electrical contacts when the holder is mechanically connected to the socket, wherein the device comprises:

a guidance means for guiding the first end of the holder relative to the socket between a separation position and a connection position, and a fastener including a head, a tail, a first stem extending from the head to the tail, and a second stem extending from the head, the first stem being configured for passing through the holder and for being inserted at the tail into a first orifice of the socket, so as to retain the first end of the holder relative to the socket, a retaining member rigidly connected to the socket and configured for retaining the fastener, so as to rigidly connect the second end of the holder to the socket.

2. The device according to claim 1, wherein the second stem extends from the head to the tail, and being configured for being inserted at the tail into a second orifice of the socket, for rigidly connecting the first end of the holder relative to the socket.

3. The device according to claim 1, wherein the head of the fastener has a general U shape, the first stem forming a first branch of the U, the second stem forming a second branch of the U.

4. The device according to claim 1, wherein the holder is configured for pivoting about the first stem when the first stem engages the retaining member, so that the retaining member engages the second stem and so that the electrical contacts may be actuated by the shaft.

5. The device according to claim 1, wherein the socket includes a first plate and a second plate facing the first plate, the holder being configured for extending between the plates, the first end of the holder being configured for being connected to the first plate, the second end of the holder being configured for being connected to the second plate, the retaining member including a first groove and a second groove made in the second plate, the first groove being intended to receive the first stem, and the second groove being intended to receive the second stem.

6. The device according to claim 1, wherein the head of the fastener is configured for being moved in the direction of the first end of the holder, when the holder is in the connection position and the retaining member retains the head of the fastener.

7. The device according to claim 1, including a cover configured for being connected to the socket covering the head of the fastener, the cover being preferably configured for indicating at least one item of information relating to the position of the electrical contacts relative to the holder.

8. The device according to claim 1, wherein the guidance means for guiding the first end is configured for guiding the first end of the holder in translation from the separation position to the connection position, preferably in rectilinear translation.

9. The device according to claim 8, wherein the guidance means for guiding the first end includes a notch in the socket and a protuberance of the first end of the holder which is intended to be inserted into the notch.

10. The device according to claim 1, wherein the first stem and/or the second stem is/are configured for passing through the electrical contacts, for immobilizing the electrical contacts relative to the holder.

11. The device according to claim 1, wherein the electrical contacts are auxiliary contacts configured for providing an item of information representative of the status of the main contacts, being actuated by the shaft.

12. A connection method for connecting an electrical contact block to a socket of an electrical switching device according to claim 1, comprising:

the guidance of the first end of the holder relative to the socket from the separation position to the connection position, and the insertion of the first stem through the holder into the first orifice, and the connection of the fastener to the retaining member, so that the holder is rigidly connected to the socket and the electrical contacts may be actuated by the shaft.

13. The connection method according to claim 12, wherein the holder pivots about the first stem when the first stem engages the retaining member and before the second stem engages the retaining member, so that the retaining member engages the second stem and the electrical contacts may be actuated by the shaft.

14. An electrical contact block for an electrical switching device, comprising:

electrical contacts and a holder including housings for the electrical contacts, the holder including a first end and a second end opposite the first end, the electrical contacts being configured for being actuated by a shaft of the device that is rotatably mobile relative to a socket of the device, when the holder is mechanically connected to the socket, wherein the electrical contact block includes:

a guidance means for guiding the first end of the holder relative to the socket between a separation position and a connection position, and a fastener including a head, a tail, a first stem extending from the head to the tail, and a second stem extending from the head, the first stem being configured for being inserted at the tail into a first orifice of the socket, so as to retain the first end of the holder relative to the socket, the fastener being configured for being retained relative to the socket by a retaining member of the device, for rigidly connecting the second end of the holder to the socket.

* * * * *